US007229027B2

(12) United States Patent
Ehresman et al.

(10) Patent No.: US 7,229,027 B2
(45) Date of Patent: Jun. 12, 2007

(54) WATERFALL-PRODUCING DEVICE

(75) Inventors: Adrian Ehresman, Melbourne, FL (US); Paul Koren, Orlando, FL (US); Daniel Kim, Orlando, FL (US)

(73) Assignee: Nexxus Lighting, Inc., Orlando, FL (US)

( * ) Notice: Subject to any disclaimer, the term of this patent is extended or adjusted under 35 U.S.C. 154(b) by 0 days.

(21) Appl. No.: 11/264,827

(22) Filed: Oct. 31, 2005

(65) Prior Publication Data

US 2007/0095933 A1 May 3, 2007

(51) Int. Cl.

| | |
|---|---|
| ***B05B 17/08*** | (2006.01) |
| ***B05B 1/36*** | (2006.01) |
| ***B05B 1/00*** | (2006.01) |
| ***F21S 8/00*** | (2006.01) |
| ***F21V 33/00*** | (2006.01) |
| ***E04H 4/00*** | (2006.01) |

(52) U.S. Cl. ..... 239/18; 239/17; 239/193; 239/597; 4/507; 362/96

(58) Field of Classification Search ..... 239/18, 239/17, 193, 597, 16, 20, 21, 23, 200, 273, 239/282, 590, 596; 4/507, 492, 508, 509, 4/541.1, 541.3, 541.6, 567–570; 362/96
See application file for complete search history.

(56) References Cited

U.S. PATENT DOCUMENTS

| | | | | |
|---|---|---|---|---|
| 4,881,280 | A * | 11/1989 | Lesikar | 4/507 |
| 5,115,974 | A * | 5/1992 | Tobias et al. | 239/23 |
| 5,893,179 | A * | 4/1999 | Johnson | 4/507 |
| 6,132,056 | A * | 10/2000 | Ruthenberg | 362/96 |
| 6,170,094 | B1 * | 1/2001 | Weise et al. | 4/507 |
| 6,196,471 | B1 * | 3/2001 | Ruthenberg | 239/18 |
| 6,367,100 | B2 * | 4/2002 | Koren et al. | 4/507 |
| 6,375,342 | B1 * | 4/2002 | Koren et al. | 362/562 |
| 6,450,418 | B1 | 9/2002 | Simpson et al. | |
| 6,484,952 | B2 * | 11/2002 | Koren | 239/18 |
| 6,595,435 | B1 * | 7/2003 | Cardenas | 239/17 |
| 6,595,675 | B2 * | 7/2003 | Dongo | 362/562 |
| 6,901,925 | B2 * | 6/2005 | Coughlin | 126/500 |
| 2006/0021127 | A1 * | 2/2006 | Li et al. | 4/507 |

* cited by examiner

*Primary Examiner*—Kevin Shaver
*Assistant Examiner*—Darren Gorman
(74) *Attorney, Agent, or Firm*—Akerman Senterfitt

(57) ABSTRACT

Devices for producing waterfalls, which provide a decorative effect in pools, spas, bathtubs, and sinks. The devices include a water inlet, and a water chamber connected to the water inlet. An elongated water outlet is connected to the water chamber, such that water exiting the water outlet forms a waterfall-type flow. In one arrangement, a light chamber including at least one lamp is included. The light chamber has a window which allows light generated by the lamp to shine through the water outlet. In another arrangement, the elongated water outlet is provided on an outlet insert, the insert and water chamber having complementary inclined surfaces such that the outlet insert may be positioned at varying distances from the water chamber. In a further arrangement, a plurality of pins are located at the egress of the water chamber, the pins acting as baffles to the flow of water through the device.

17 Claims, 5 Drawing Sheets

WATERFALL-PRODUCING DEVICE

CROSS-REFERENCE TO RELATED APPLICATIONS

Not applicable.

FIELD OF THE INVENTION

This invention is directed generally to waterfall-producing devices, and more particularly to devices for creating a waterfall effect from a water source in pools, spas, bathtubs, sinks and the like.

BACKGROUND

It is known to produce a decorative waterfall effect for water entering a pool, spa, bathtub, sink and the like. The waterfall effect typically involves forcing water over an elongated lip of a container, or through an elongated aperture to create a "sheet" of water.

U.S. Pat. No. 6,450,418 describes a pool/spa waterfall apparatus. The apparatus includes a manifold body connected to a water inlet. The manifold body has at least one baffle for reducing water turbulence, and an elongated removable outlet cap having either an elongated slot or a plurality of apertures forming a water outlet. The removable outlet cap is mounted to the manifold body by screws, and may be removed for cleaning or replaced with an outlet cap having a different aperture design. The baffles extend longitudinally in the manifold housing, and may be horizontally positioned, or may be inclined to the horizontal.

The prior art waterfall-producing devices are not adjustable, and therefore always produce the waterfall at the same distance from the device. This may not be appropriate for all installations, as it may be desirable to alter the distance from the device that the water travels, due to variations in the sizes and positioning of the walls of bathtubs, sinks, spas and the like.

Additionally, the prior art waterfall-producing devices are not illuminated, and so if a user desires to have soft or decorative lighting in addition to the waterfall effect, they must install or provide extra lighting.

A need exists for a waterfall-producing device capable of overcoming these and other disadvantages of the conventional systems, and in particular for a device that allows for the waterfall to be lit.

SUMMARY OF THE INVENTION

The present invention concerns a waterfall-producing device which has a water inlet, a water chamber connected to the water inlet. An elongated water outlet is connected to the water chamber, such that water exiting the water outlet forms a waterfall-type flow.

In one arrangement, the device further includes a light chamber including at least one lamp, wherein the light chamber is separate from the water chamber. At least one window is positioned on a wall of the light chamber, wherein the at least one window allows light generated by the at least one lamp to shine through the elongated water outlet.

The light chamber is preferably level with the elongated water outlet. The water chamber and the light chamber may be provided in a housing, and wherein the light chamber is located above the water chamber. The elongated water outlet may be located level with the light chamber window, such that the water is forced to flow in an upward path from the water chamber to the elongated water outlet. The water may be forced to flow in a serpentine path from the water chamber to the elongated water outlet.

The at least one lamp may be an LED. In one example, a plurality of LEDs may be provided on a lamp array. The light chamber may include a removable cover such that the at least one lamp can be accessed for servicing.

In another arrangement, the elongated water outlet is provided on an elongated outlet insert, the elongated outlet insert and the water chamber having complementary inclined surfaces such that the outlet insert may be positioned at varying distances from the water chamber. The inclined surface provided on the elongated outlet insert may be provided on at least one side wall to a water path through the water outlet.

In a further arrangement, a plurality of pins are located at the egress of the water chamber, such that the pins act as baffles to the flow of water through the apparatus. The pins may have a circular, oval or polyhedral cross-section. The pins may be arranged in a plurality of rows, for example, three rows of pins may be provided.

These and other aspects and features of the invention will become apparent upon review of the enclosed drawings and detailed description below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF CERTAIN EMBODIMENTS OF THE INVENTION

Figure 1:
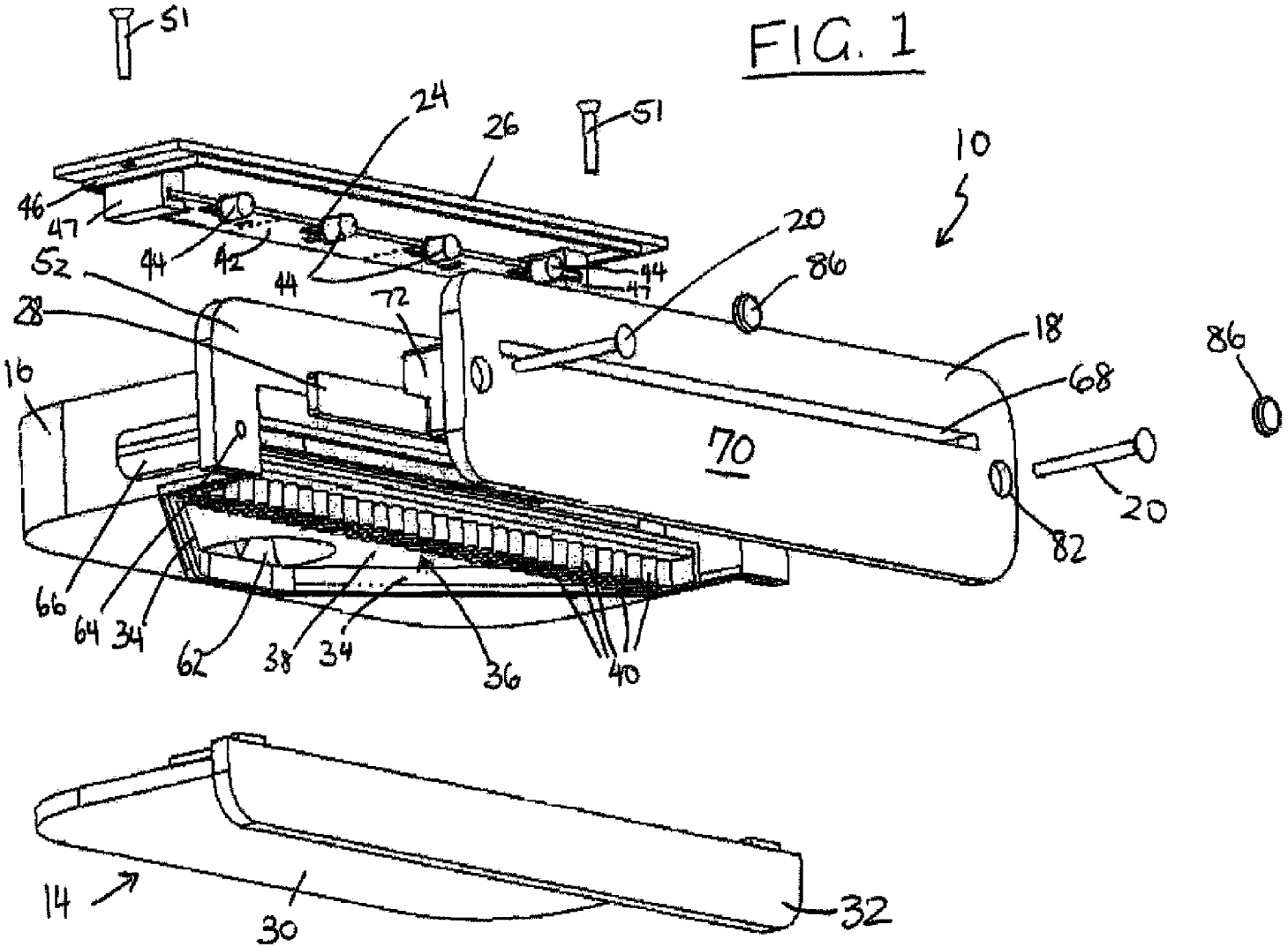
FIG. 1 is an expanded perspective view of a waterfall-producing device constructed in accordance with the present invention.
Figure 2:
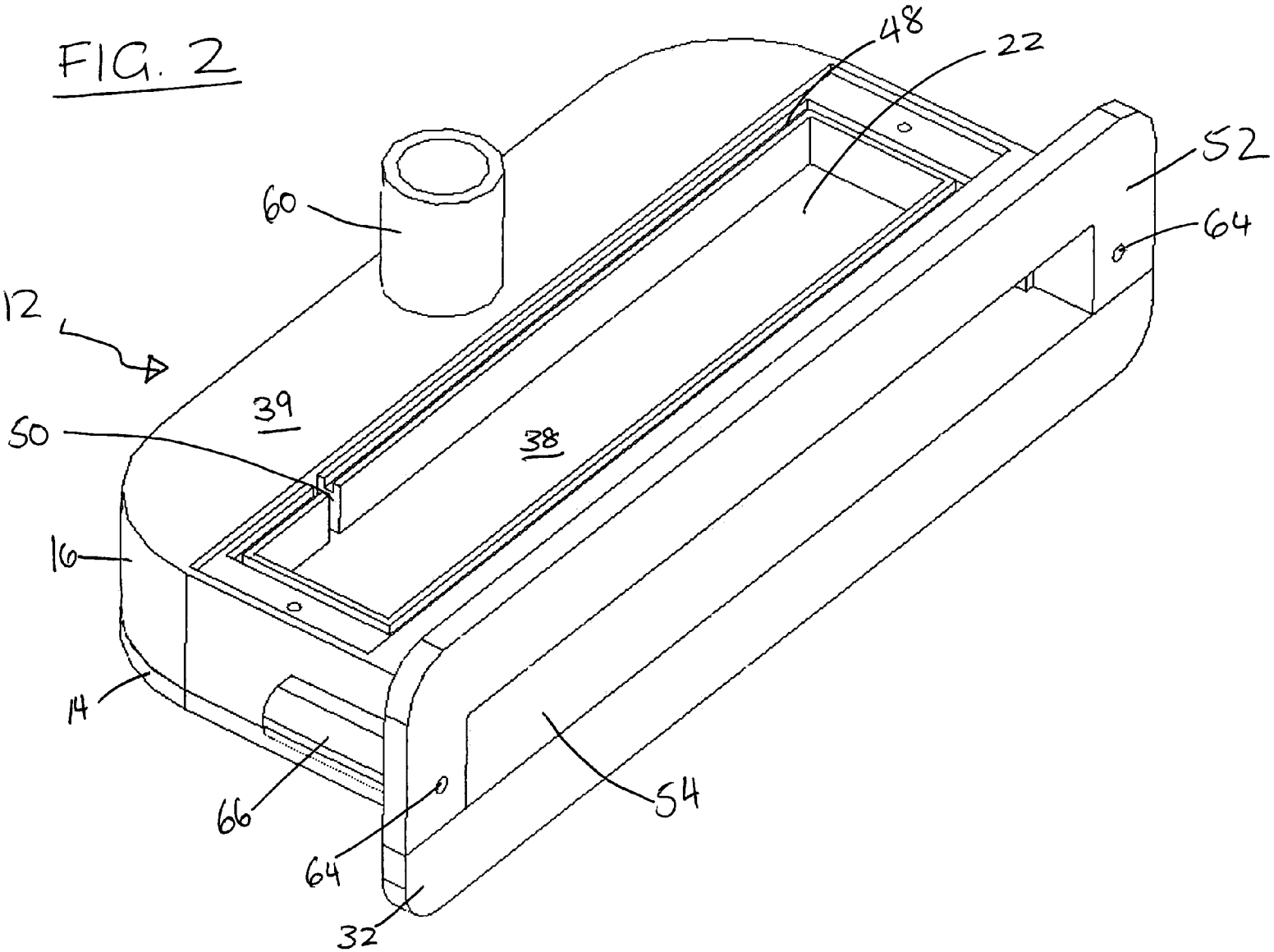
FIG. 2 is a perspective view of the housing of the basic construction of FIG. 1.

This invention is directed to a waterfall-producing device 10 which may have numerous configurations capable of forming a decorative waterfall effect using water or other liquids. The waterfall-producing device 10 may be used in pools, spas, bathtubs, sinks and the like.

Referring to the drawings, an embodiment of a waterfall-producing device 10 is shown. The waterfall producing device 10 comprises a housing 12, that may be formed from two parts 14, 16. An outlet cover 18 may be attached to the housing 12 by screws or other securing means 20. A light chamber 22 is formed in the housing 12, and includes a lamp array 24. A light chamber cover 26 may close the light chamber, and a window 28 is included along one wall of the light chamber 22.

The housing 12 may be formed of any suitable material. Particularly preferred are plastic or nylon materials, because such materials are hardwearing, easy to manufacture, water resistant, and are electrical insulators. Any suitable material can of course be used.

A lower part 14 of the housing 12 may be formed generally as a plate 30 with a lip 32 extending at 90° to the plate. An upper part 16 of the housing can include side walls 34 to form a water chamber 36 between the upper and lower housing parts. A plate 38 forms an upper wall to the water chamber 36 and a lower wall to the light chamber 22, which is defined in the upper part of the housing part 16 beneath an upper plate 39. The plate 30 of the lower housing part 14 forms the lower wall of the water chamber 36. A plurality of pins 40 depend from the plate 38, and define one side of, and the egress from, the water chamber 36. The pins 40 extend the full height of the water chamber 36.

In the illustrated arrangement, three rows of pins 40 are provided, although it will be appreciated that any suitable number of pins may be used. The pins 40 form baffles to the flow of water through the device as the water flows around and between the pins, and additionally form a screen across the egress of the water chamber 36 when the housing 12 is assembled. The screen can prevent leaves, dirt and other contaminants from entering the water chamber 36 and the water supply. It will be appreciated that the pins 40 may have any suitable shape, and may have a circular or oval cross-section. The cross-section of the pins 40 may also be polyhedral, provided that the corners are rounded so that triangular, kite-shaped or any other suitable polyhedral cross-sectional shape.

The light chamber 22 is a simple rectangular space in the illustrated arrangement, and is designed to receive the lamp array 24. The light chamber 22 may be defined in an upper part of the upper housing part 16. In the illustrated arrangement, the lamp array 24 can include a circuit board 42 from which four LED lamps 44 extend. The LED lamps may have any color, and desirable lighting effects may be created by using lamps of one color, such as blue or green, or mixing lamps of different colors. If desirable, each LED lamp in the array may be separately operated so that a lighting pattern may be created by turning the lamps on and off at differing times, or so that the lamps may be flickered for a twinkling effect. A lip 46 may be provided around the light chamber cover 26, which seats in a complementary recess 48 provided in the plate 39 around the edge of the light chamber 22. The lip 46 and recess 48 ensure that the light chamber 22 is suitably watertight. An attachment piece 47 may be attached to the cover 46 to hold the lamp array 24 in place. A power lead cutout 50 is provided in the wall of the light chamber 22 and in the light chamber cover 26 (not shown) so that a power lead may be connected to the lamp array 24. It will of course be appreciated that any suitable light source and any suitable number and type of lamps may be used. For example, the light source may be a fiber optic cable or cables, incandescent bulbs or any other light source, and the invention is not limited in this regard. The light chamber cover 26 is secured to the housing 12 with screws 51.

The window 28 forms one wall of the light chamber 22. The window may be formed of any suitable material, such as a plastic material, glass or crystal, and is transparent or translucent. The window 28 may be sealed in place with any suitable waterproof sealant, such as a silicon sealant. The light chamber 22 is thus sealed from contact with water in the device 10. In the illustrated arrangement, the light chamber 22 is designed to be located above the water chamber 36, which reduces the likelihood that water will drip down into the light chamber 22.

Figure 3:
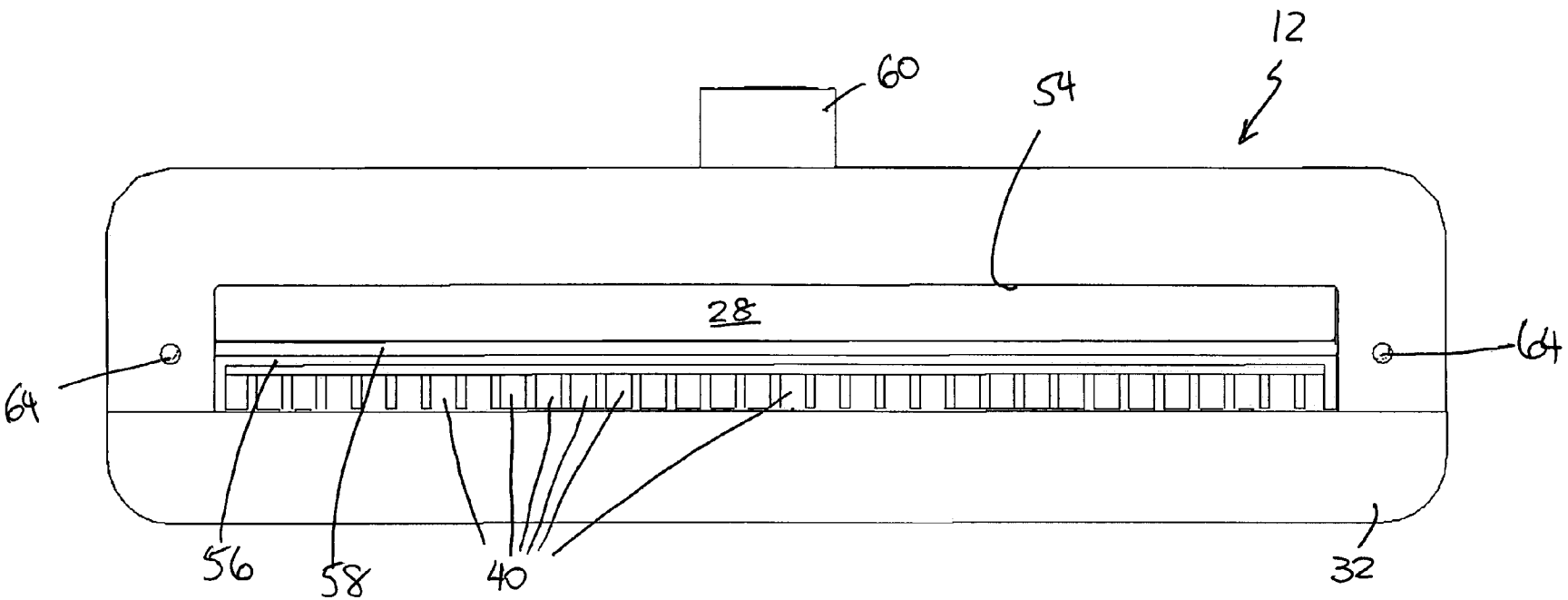
FIG. 3 is a font view of the housing of the basic construction of FIG. 1.
Figure 4:
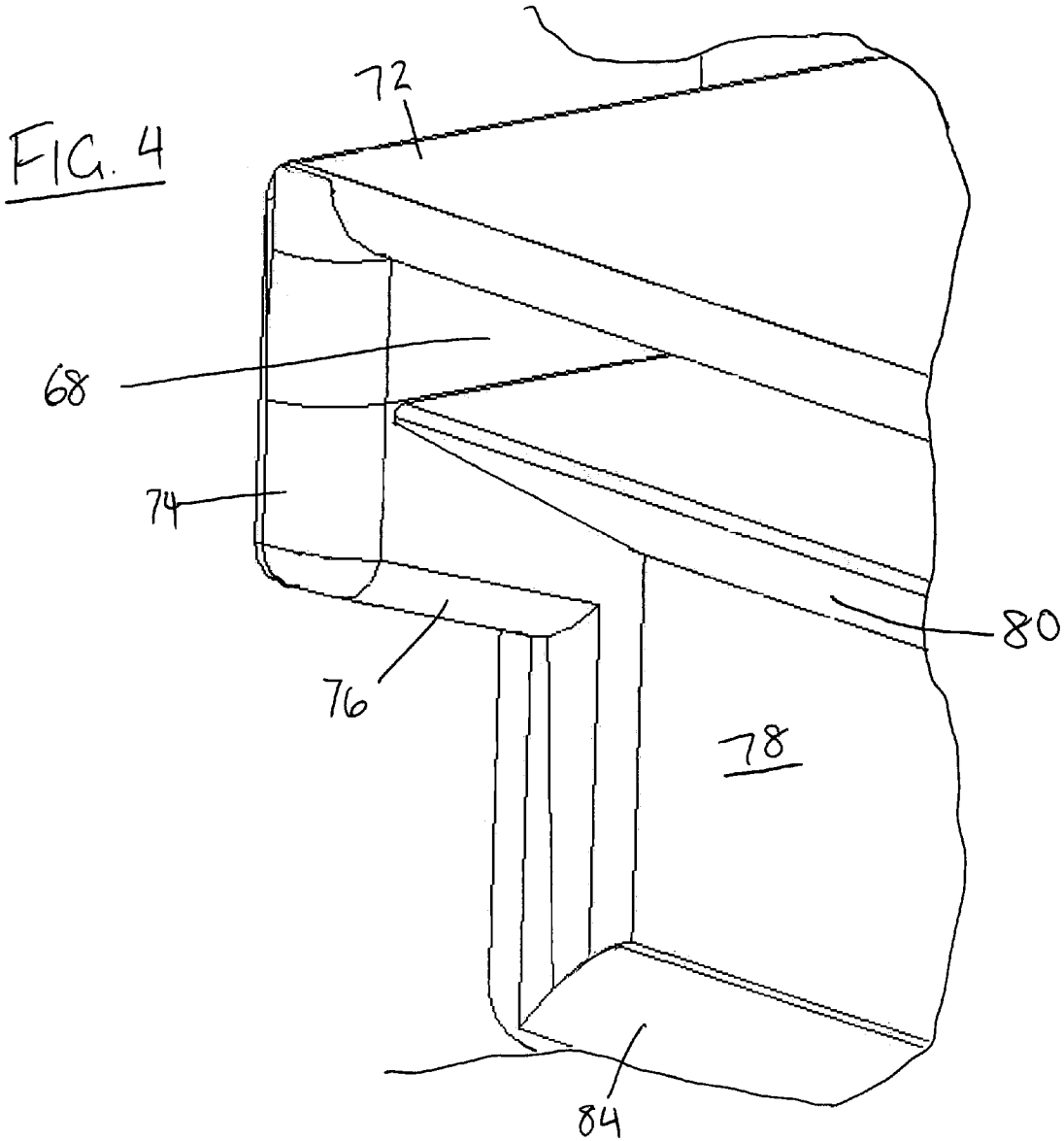
FIG. 4 is an expanded cut-away view of a portion of the outlet cover of the basic construction of FIG. 1.
Figure 5:
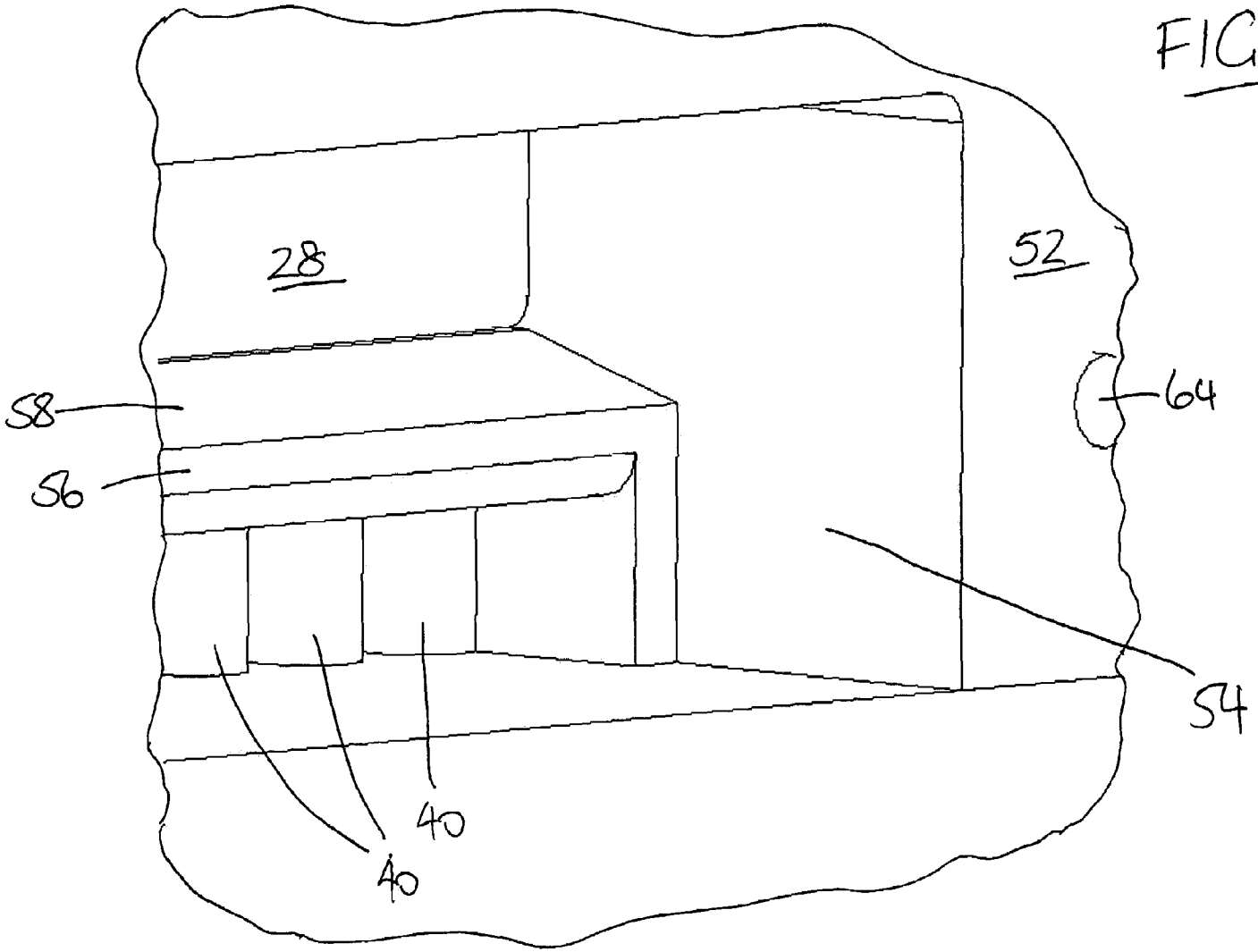
FIG. 5 is an expanded cut-away view of a portion of the housing of the basic construction of FIG. 1.

The upper housing part 16 can include a lip 52, which adjoins lip 32 when the lower and upper housing parts 14, 16 are brought together. The two housing parts 14, 16 are joined together using a waterproof sealant, such as a silicon sealant. The lips 32, 52 thus form a flange that enables the device 10 to be securely installed in a wall adjacent a pool, spa, bathtub, sink or the like. The lips 32, 52 also define an elongated aperture 54, through which the window 28 and the pins 40 are visible (see FIG. 3). An elongated projection 56 extends longitudinally across the housing part 16 between the window 28 and the pins 40. The elongated projection 56 includes an inclined surface 58.

A water inlet pipe 60 is provided, and extends through the upper housing part 16, terminating in an aperture 62 in the plate 38. The water inlet pipe 60 allows water to enter the water chamber 22. Also included on the upper housing part 16 are screw holes 64, and sleeves 66 for receiving screws 20 when the outlet cover 18 is connected to the housing 12.

The outlet cover 18 includes an elongated water outlet slot 68 on a convexly curved front surface 70. At the back of the outlet cover 18, the water outlet slot 68 extends through an upper part of a projection 72. The projection 72 includes side walls 74 having an inclined section 76. The inclined section 76 is complementary to the inclined surface 58 of the housing 12. At a lower part of the projection 72, a wall 78 and inclined surface 80 can be designed to direct water to the outlet slot 68. Screw holes 82 are provided through the outlet cover 18. A lower lip 84 extends from the wall 78.

The outlet cover 18 may be formed of any suitable material. As the outlet cover 18 is visible once the device 10 has been installed, the outlet cover 18 may be formed from a decorative material such as ceramic, porcelain, natural materials such as stone, stainless steel or any other suitable metal. Alternatively, the outlet cover 18 may be formed of a plastic or nylon material. The front surface 70 may be coated, such that the body of the outlet cover 18 may be formed of a plastic or nylon material, with a layer of a metallic, ceramic or other material.

To assemble and install the device 10, the housing parts 14, 16 are joined together and sealed. The lamp array 24 or other light source is installed into the light chamber 22, and connected to a source of electrical power. The housing 12 is then installed into a wall or other surface, with the flange formed by lips 32, 52 on the surface of the wall, and the remainder of the housing 12 installed in the interior of the wall. A water pipe is connected to the water inlet pipe 60.

After installation of the housing 12, the outlet cover 18 is inserted into the aperture 54. The projection 72 is sized to snugly fit within the aperture 54 so that water does not leak around the sides of projection 72. The outlet cover 18 may be pushed inwardly with the walls 74 of the projection 72 traveling across inclined surface 58. The lower lip 84 and the walls 74 prevent the outlet cover 18 from being pushed in too far, such that a water path is created through the device. Water can flow through the device from the water inlet pipe 60 to the water chamber 22 and past pins 40, which act as baffles and reduce turbulence in the flow. The water then flows up against the wall 78, over the inclined surface 58 and exits the device through the elongated water outlet slot 68. The side walls 74 act as side walls to the water path to prevent water leakage to the sides of the projection 72, and hence to the sides of aperture 54. The inclined surface 80 smoothes the water flow somewhat as it changes direction from wall 78 to inclined surface 58. The convexly curved front surface 70 to the outlet cover 18 allows for a smooth flow of water from the water outlet slot 68 if the water pressure is not sufficient to propel the water a short distance from the outlet slot 68 during formation of the waterfall effect. The light chamber 22 is level with the outlet slot 68 after assembly, so that light emitted by the lamp array 24 can shine through the outlet slot 68.

It should be noted that the size of the egress of the water chamber 22 is approximately the same size as the water outlet slot 68. This allows water to flow smoothly through the device 10, reducing the likelihood of turbulence and water backup in the device.

The outlet cover may be positioned at any suitable distance from the housing 12, depending on the installation that the device 10 is to be used for. In some instances, it is desirable to extend the outlet cover 18 so that the waterfall-effect flow produced from the water outlet slot 68 can extend different distances into the pool, spa, bathtub, sink or other water container. This can be useful to prevent splashing from water descending onto a side wall of the water container. Once the outlet cover 18 is positioned as desired for the particular installation, the outlet cover 18 is secured to the housing 12 using screws 20 that are threaded through aligned screw holes 82, screw holes 64 and screw sleeves 66. The screw heads may be covered using insert pieces 86.

When the power to the lamp array 24 is switched on, the light from the lamp array 24 shines through the window 28 and illuminates the flow of water through the outlet slot. A separate electrical power switch may be provided so that the lamp array 24 may be operated independently of the water flow, or the power supply switch may be activated by power to the water pump that drives the water flow to the water inlet pipe. If necessary, the lamp array 24 may be serviced or replaced after installation by removing the light chamber cover 24.

It will be appreciated that, although terms such as upper, lower, front, and back have been included in this description, these are merely used to aid in the description of the features. Although the device 10 has a preferred orientation in use, it will function if installed in an orientation different from the illustrated embodiment. In such a case, parts described herein as being upper or lower will be reversed or altered, and the invention is not intended to be limited in this regard.

The foregoing is provided for purposes of illustrating, explaining, and describing embodiments of this invention. Modifications and adaptations to these embodiments will be apparent to those skilled in the art and may be made without departing from the scope or spirit of this invention. All publications and patents mentioned herein are incorporated by reference in their entirety, including all figures, graphs, equations, illustrations, and drawings to describe and disclose specific information for which the reference was cited.

The invention claimed is:

1. A waterfall-producing device comprising:

a water inlet;

a water chamber connected to the water inlet; and an elongated water outlet connected to the water chamber wherein water exiting the water outlet forms a waterfall-type flow;

wherein the elongated water outlet is provided on an elongated outlet insert, the elongated outlet insert and the water chamber having complementary inclined surfaces such that the outlet insert may be positioned at varying distances from the water chamber.

2. The device according to claim 1, further comprising:

a light chamber including at least one lamp, wherein the light chamber is separate from the water chamber; and at least one window positioned on a wall of the light chamber, wherein the at least one window allows light generated by the at least one lamp to shine through the elongated water outlet.

3. The device according to claim 2, wherein the light chamber is located level with the elongated water outlet.

4. The device according to claim 3, wherein the elongated water outlet is located level with the light chamber window, and wherein the water is forced to flow in an upward path from the water chamber to the elongated water outlet.

5. The device according to claim 4, wherein the water is forced to flow in a serpentine path from the water chamber to the elongated water outlet.

6. The device according to claim 2, wherein the water chamber and the light chamber are provided in a housing, and wherein the light chamber is located above the water chamber.

7. The device according to claim 2, wherein the at least one lamp is an LED.

8. The device according to claim 7, wherein a plurality of LEDs are provided on a lamp array.

9. The device according to claim 2, wherein the light chamber includes a removable cover such that the at least one lamp can be accessed for servicing.

10. The waterfall-producing device according to claim 1, wherein the inclined surface provided on the elongated outlet insert is provided on at least one side wall to a water path through the water outlet.

11. A waterfall-producing device comprising:

a water inlet;

a water chamber connected to the water inlet;

an elongated water outlet connected to an egress of the water chamber, wherein water exiting the water outlet forms a waterfall-type flow; and a plurality of pins located at the egress of the water chamber, wherein the pins act as baffles to the flow of water through the apparatus.

12. The waterfall-producing device according to claim 11, wherein the pins have a cross-section selected from the group consisting of circular, oval and polyhedral with rounded corners.

13. The waterfall-producing device according to claim 11, wherein the pins are arranged in a plurality of rows.

14. The waterfall-producing device according to claim 13, wherein three rows of pins are provided.

15. A waterfall-producing device comprising:

a water inlet;

a water chamber connected to the water inlet;

an elongated water outlet connected to an egress of the water chamber, wherein water exiting the water outlet forms a waterfall-type flow;

at least one baffle to the flow of water through the apparatus;

a light chamber including at least one lamp, wherein the light chamber is separate from the water chamber; and at least one window positioned on a wall of the light chamber, wherein the at least one window allows light generated by the at least one lamp to shine through the elongated water outlet, wherein the elongated water outlet is provided on an elongated outlet insert, the elongated outlet insert and the water chamber having complementary inclined surfaces such that the outlet insert may be positioned at varying distances from the water chamber.

16. The waterfall-producing device according to claim 15, wherein the at least one baffle comprises a plurality of pins extending across the egress of the water chamber.

17. The waterfall-producing device according to claim 15, wherein the at least one lamp is an LED.

* * * * *